US007373864B2

(12) United States Patent
Granger

(10) Patent No.: US 7,373,864 B2
(45) Date of Patent: May 20, 2008

(54) DEVICE FOR CONTROLLING THE OUTWARD MOVEMENT OF THE CUTTING BLADE OF A DRUM IN A WIPING MATERIAL DISPENSER

(76) Inventor: Maurice Granger, 17 Rue Marcel Pagnol, 42270 Saint Priest En Jarez (FR)

( * ) Notice: Subject to any disclaimer, the term of this patent is extended or adjusted under 35 U.S.C. 154(b) by 53 days.

(21) Appl. No.: 10/933,047

(22) Filed: Sep. 2, 2004

(65) Prior Publication Data

US 2005/0051008 A1 Mar. 10, 2005

(30) Foreign Application Priority Data

Sep. 5, 2003 (FR) ..... 03 10626

(51) Int. Cl.
*B26D 1/56* (2006.01)

(52) U.S. Cl. ..... 83/298; 83/334; 83/337; 83/338; 225/72

(58) Field of Classification Search ..... 83/337, 83/648–650, 338, 334, 298, 314; 225/72, 225/96, 103, 106
See application file for complete search history.

(56) References Cited

U.S. PATENT DOCUMENTS 1,717,706 A * 6/1929 Harris ..... 74/32
4,188,844 A * 2/1980 DeLuca ..... 83/337
4,307,638 A * 12/1981 DeLuca et al. ..... 83/649
5,937,718 A 8/1999 Granger ..... 83/334
5,979,284 A * 11/1999 Granger ..... 83/649
6,363,825 B1 * 4/2002 Hagleitner ..... 83/337
6,378,725 B1 * 4/2002 Granger ..... 83/337
6,457,394 B1 * 10/2002 Granger ..... 83/649
6,474,209 B1 * 11/2002 Granger ..... 83/649
6,497,167 B1 * 12/2002 Granger ..... 83/337
2001/0045149 A1 * 11/2001 Granger ..... 83/649
2002/0152870 A1 * 10/2002 Granger ..... 83/649
2002/0152871 A1 * 10/2002 Granger ..... 83/649

FOREIGN PATENT DOCUMENTS

EP 317448 A1 * 5/1989
FR 2705330 A1 * 11/1994
JP 01221569 * 9/1989

(Continued)

*Primary Examiner*—Jason Prone
(74) *Attorney, Agent, or Firm*—Heslin Rothenberg Farley & Mesiti P.C.

(57) ABSTRACT

A device for controlling outward movement of a cutting blade of a drum in wiping material dispensing equipment is distinctive in that one of the flanges of the casing is designed with rings having a fixed position and formed during molding of an inner side of the flange facing the drum and being applied against a facing edge of the drum. The end flange of the drum on its lateral edge has a projecting profile forming a bar arranged for the fixing and pivoting of the blade holder and having a cutout to receive a locking member formed on a lever mounted to pivot with the blade holder. Each of a first central ring and the lever located on the flange and the drum, respectively has two shaped protuberances which interact at certain stages of operation. One of the other rings formed on the flange is designed to interact with the locking member formed on said lever at certain stages of operation when the drum rotates.

9 Claims, 9 Drawing Sheets

FOREIGN PATENT DOCUMENTS

| | | | |
|---|---|---|---|
| WO | WO 9606557 A1 * | 3/1996 | |
| WO | WO 9803108 A1 * | 1/1998 | |
| WO | WO 9960907 A1 * | 12/1999 | |
| WO | WO00/40132 | 7/2000 | |
| WO | WO 2005112725 A1 * | 12/2005 | |
| WO | WO 2007017603 A1 * | 2/2007 | |

* cited by examiner

Fig. 8
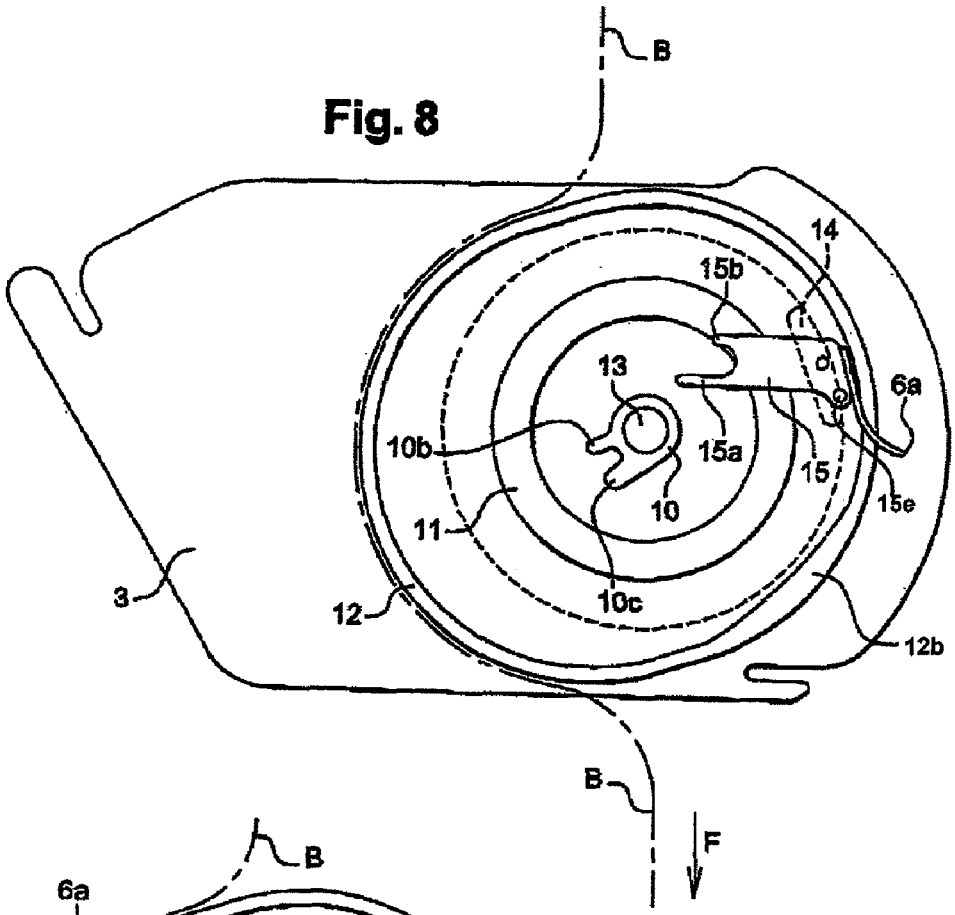
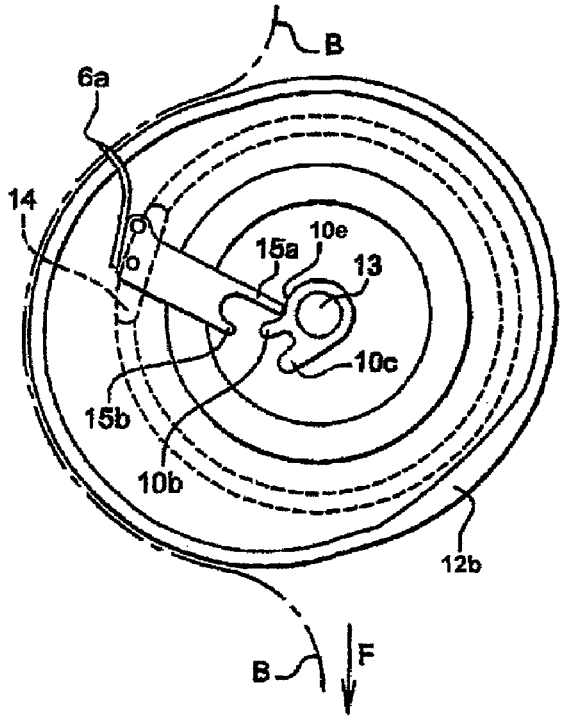
Fig. 9

DEVICE FOR CONTROLLING THE OUTWARD MOVEMENT OF THE CUTTING BLADE OF A DRUM IN A WIPING MATERIAL DISPENSER

BACKGROUND OF THE INVENTION

The invention relates to the technical field of equipment for dispensing wiping materials such as paper or the like for wiping the hands or for use as toilet paper, the strip of material being in a folded or unfolded position.

The principle of this equipment was defined in the applicant's French patents FR 2332215 and 2340887, particularly as regards the device for controlling and moving the cutting blade into and then out of the drum in order to cut the strip of material pulled by the user.

To enable the field of the invention to be understood, it will be briefly mentioned that a piece of equipment of this type comprises a casing receiving a protective cover. The upper part of this casing receives supporting arms of a wiping material reel holder. In the lower part of the casing, a drum is fitted so that it can rotate freely between supporting flanges, and is designed to receive a cutting device comprising a blade and a blade holder inside the drum, which moves out of the drum for cutting. In the French patents cited above, a cam device is provided on one side of the drum and comprises a cam associated with the shaft of the drum and a cam follower associated with the axis of the blade holder, enabling the blade to move outwards when the drum rotates. A specific embodiment of the patent FR 2340887 also provides a cam slot formed on the flange of the drum receiving the cam follower.

To tackle the problem posed by the variations in quality and thickness of the reels of wiping material, and to improve the cutting, the applicant has developed a design of the device for controlling the outward movement of the blade described in PCT patent WO 00/40132. In this document, the device comprises, on one of the flanges and around a ring for the passage of the locking axis of the drum, a fixed profile forming a single unit with the body of the flange, constituting a guide path for a complementary part associated with the blade holder, the fixed profile and the complementary part having projecting profiles in the form of teeth to interact with each other when the drum rotates, creating an amplitude effect in relation to the movement of the part forming a lever when it swings, thus facilitating the cut. The shape of the complementary part is thus shown in FIGS. 1 and 2 to make its configuration clear. The cutting blade is therefore subjected to a movement out of the drum and then back into it, as a result of the position of the single-unit part associated with the blade holder with respect to the fixed profile forming the cam. In this embodiment, the blade holder requires the use of an elastic return spring.

The solution described in this PCT patent WO 00/40132 is entirely satisfactory when the diameter of the drum of the dispensing equipment is made to dispense material with a format of 13 inches. However, when smaller formats are required, of the order of 111 inches for example, difficulties have been encountered in pulling the strip of material, these difficulties being increased by the variable quality and thickness of the reels of material.

Since dispensing equipment with automatic cutting must have the best possible performance in view of its conditions of use, the applicant has sought a solution to further improve the operation of this type of equipment, in order to provide a high quality of operation for dispensing and cutting strips of wiping material in small formats, for example of the order of 11 inches or less.

As part of the same process and in the same context, the applicant wished to make the equipment even quieter by suppressing the clicking which occurs in particular when the cutting blade returns into the drum, as a result of the noise due to the stress of the return spring associated with the blade holder and incorporated in the drum.

These objects and others will be made clear by the remainder of the description.

SUMMARY OF THE INVENTION

According to a first characteristic, the device for controlling the outward movement of the blade is distinctive in that one of the flanges of the casing for fixing the drum is designed with rings having a fixed position, formed during the molding of the inner side of the flange facing the drum and being applied against the facing edge of the drum, and in that the end flange of the drum on its lateral edge has a projecting profile forming a bar designed for the fixing and pivoting of the blade holder and having a cutout to receive a locking member formed on a fitted lever which is pivoted with the blade holder, and in that each of a first ring located on the flange and the lever associated with the drum has two shaped protuberances which can interact with each other at certain stages of operation, and in that one of the rings formed on the flange is designed to interact with the locking member formed on said lever at certain staged of operation when the drum rotates.

These characteristics and others will be made clear by the remainder of the description.

BRIEF DESCRIPTION OF THE DRAWING FIGURES

Aspects of the invention are illustrated, without restrictive intent in the figures of the drawings in which:

FIGS. 8 to 15 show the various stages of operation of the device according to the invention.

DETAILED DESCRIPTION

In order to make the object of the invention clearer, it will now be described as illustrated without restrictive intent in the figures of the drawings.

Figure 1:
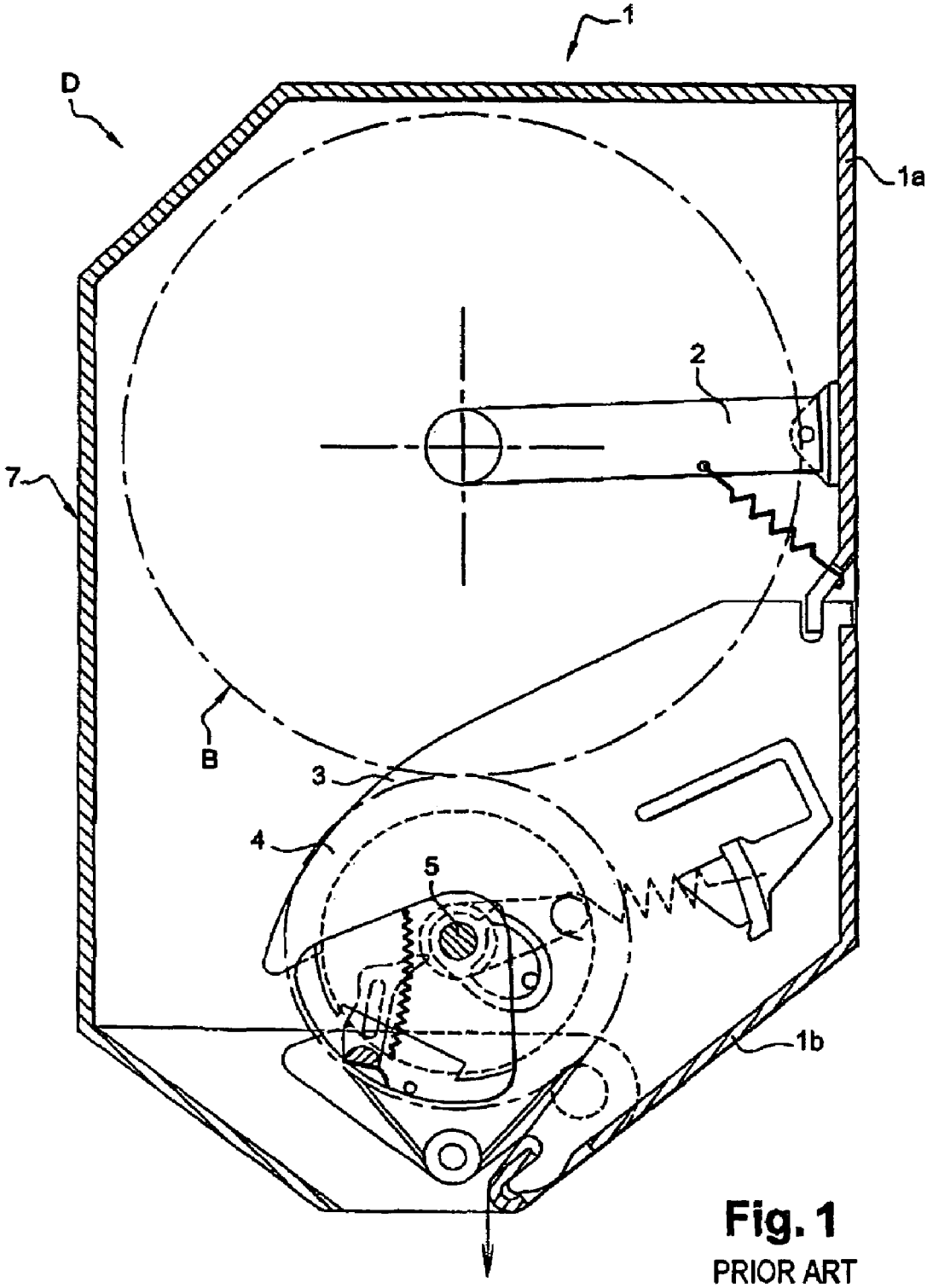
Fig. 1 PRIOR ART
FIG. 1 shows a side view of dispensing equipment according to the prior art, conforming to the teaching of the aforesaid PCT patent.

Referring to FIG. 1, what is represented is dispensing equipment (D) for wiping materials, only the parts essential to the understanding of the invention being shown. The equipment comprises a casing (1) having a vertical base surface (1*a*) extended in its lower part by an inclined plane (1*b*). Reel holder arms (2) are mounted on and project from the base surface to receive the reel (B) of wiping material. One of the arms can be pivoted with the aid of a spring so that the reel can be positioned. Lower flanges (3) are mounted and fixed on the inclined plane of the casing in any appropriate way. A drum (4) is positioned between the flanges of the casing in a known way, and is mounted in a freely rotatable way by means of shafts (5) connected to the aforesaid flanges. The drum is designed in any known way, particularly according to the applicant's patents.

Figure 2:
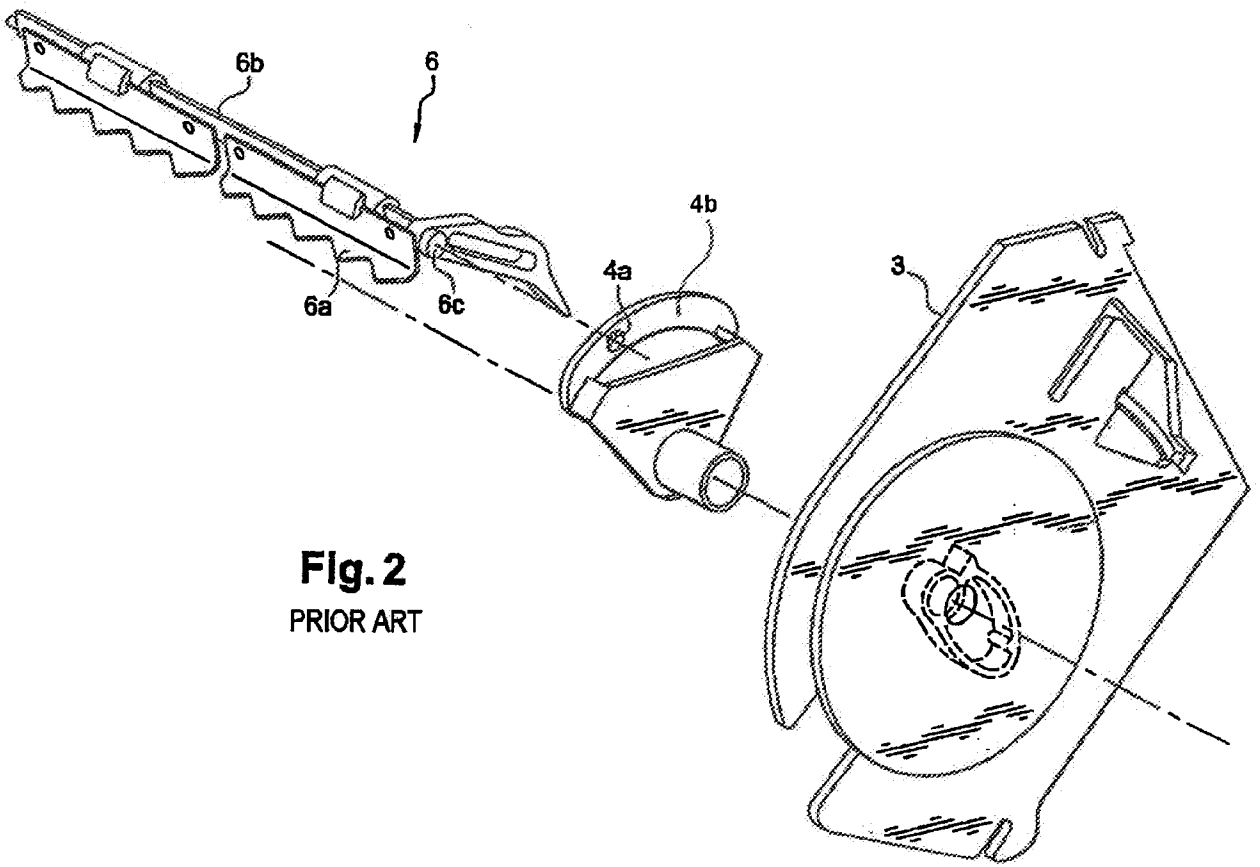
Fig. 2 PRIOR ART
FIG. 2 is a perspective view of the device for controlling the outward movement of the blade in the prior art, conforming to the teaching of the aforesaid PCT patent.

Referring now to FIG. 2, the drum receives a cutting device (6) comprising a blade holder (6*b*) and a blade (6*a*), the blade holder being pivoted by end shafts (6*c*) inserted into apertures (4*a*) formed in or near the lateral ends of the drum. These ends are designed in the form of flanges (4*b*). It is pointed out that the wiping reel can either bear directly on the drum or be suspended by the reel holder arm without contact with the drum. The strip of material is guided, regardless of the chosen variant, behind the drum, in the base part of the casing, so that it can be cut when the cutting device moves outwards beyond the outer circumference of the drum. The strip of material exits from the lower part of the equipment. A protective cover (7), as illustrated in FIG. 1, keeps the equipment closed.

The characteristics of the device for controlling the outward movement of the cutting blade according to the invention will now be described.

This device includes a special arrangement on one of the lower flanges (3) of the casing carrying the drum and a complementary special arrangement on the facing end part or flange (4*b*) of the drum.

The flange (3) of the casing is thus designed with a combination of several rings (10-11-12) in fixed positions, formed during the molding of the inner side of said flange facing the drum. These rings (10-11-12) can interact by engagement and by guiding, during the stages of operation of the device, with a bar 14 and a lever 15 provided and positioned so that they project from the transverse edge (4*c*) of the facing end flange (4*b*) of the drum (4).

Figure 3:
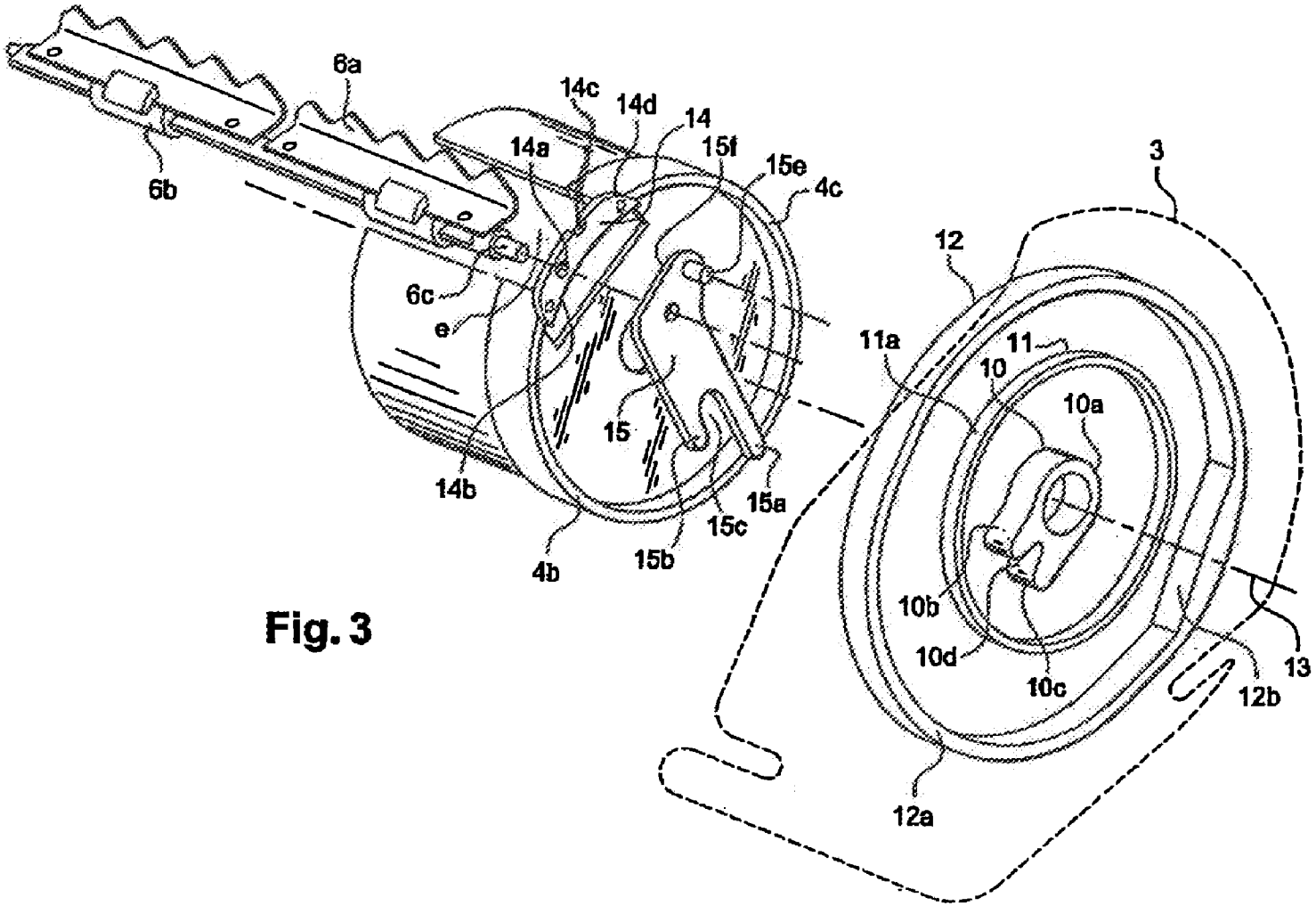
FIG. 3 is an exploded perspective of the device for controlling the outward movement of the blade according to the invention.

More specifically, the flange (3) of the casing is show in broken lines in FIG. 3 and supports, on its inner side, a first central ring (10) having a base (10*a*) for the passage of a locking axis (13) of the drum (4), this ring having on its periphery two substantially adjacent shaped protuberances (10*b*-10*c*) between which a space (10*d*) is provided, the two protuberances having some of the characteristics of teeth. The height of the first protuberance (10*b*) is significantly greater than that of the second protuberance (10*c*) relative to the drum (4). The space (10*d*) is provided to permit the passage of lever 15 positioned on the drum, as explained below.

Around the first ring (10) there is positioned a second projecting ring (11), concentric with a central axis of the base (10*a*) of first ring (10) and the locking axis (13) of the drum. The second ring (11) has a regular circular shape and its outer periphery (11*a*) can face, without contact, the lever (15) provided on the facing edge (4*c*) of the drum (4). This second ring helps to guide the lever (15) associated with the drum. The third ring (12) has a closed non-circular profile with an eccentric offset part (12*a*). This ring (12) also has internally and over a section of the order of approximately 25 to 35° a rectilinear flat (12*b*) forming an area for stopping and pushing a locking member (15*e*) projecting from the drum (4).

As shown in FIGS. 4 and 8 to 15 of the drawings, the ring (12) has a special non-circular profile, with three sectoral areas XY, YZ, ZX which are different from each other, permitting the passage of the lever (15) in the various stages of operation. The angular sector XY which is of the order of 148° is regularly circular, the sector YZ which is of the order of 118° has the radial amplitude variation and eccentricity, and the sector ZX which is of the order of 94° has a progressive decrease in radial amplitude to join and connect with the start of the first area. At the peak point Z of the amplitude of the ring (12), the distance (d2) corresponding to the width between the rings (12) and (11) is approximately 12 mm greater than the distance (d1) on the circular part of the first area. For guidance only, d1=10 mm and d2=22 mm. The peak point Z is located in the extension of the protuberance (10*c*)

The flange (3) thus formed and manufactured directly with its various interior rings (10-11-12) is capable of being applied against the facing edge (4*c*) of the flange (4*b*) of the drum (4).

A description will now be given of the different areas formed on the edge (4*c*) of said end flange (4*b*) of the drum (4) and interacting with the rings (10-11-12) formed on the inside surface of the flange (3).

In the first place, the end flange (4*b*) of the drum has, directly formed on or applied to its lateral edge (4*c*), a projecting profiled bar (14) having an aperture (14*a*) for the passage and introduction of the shaft (6*c*) of the blade holder (6) to allow the shaft to pivot and thus allow the blade holder to swing. This bar (14) has a substantially curved inner profile (14*b*) so that it faces the peripheral outer edge of the second ring (111), regardless of the stage of rotation of the drum, forming a guide path between them. Said bar has on its upper face (14*e*) opposite the lower profile (14*b*) a cutout (14*d*) housing a means having a locking function associated with the blade holder.

Figure 7:
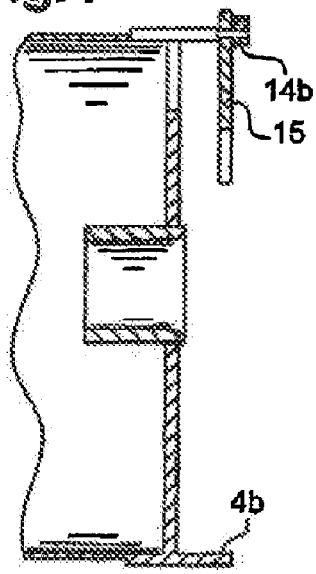
FIG. 7 is a partial view of the end of the drum.

The blade holder (6) is designed with a lever (15) shown axially displaced in the exploded view of FIG. 3, but actually positioned adjacent the space (e) formed between the last part of the blade (6*a*) and an interior surface of the projecting bar (14) at the end of the drum, as best seen in FIG. 7. Pivot shaft (6*c*) extends through lever (15) into a pivotal coupling in aperture (14*a*) of bar (14). This lever (15) is designed in a very distinctive way to permit, on the one hand, the outward movement of the cutting blade by interaction with the first ring (10) and the protuberances (10*c*) (10*b*) in particular, and the inward return of the blade after the cut, being locked in position in the cutout (14*d*) formed in the bar (14). More specifically, the lever (15) is fixed to the blade holder and is therefore closely associated with the latter in its movement. Lever (15) has in its lower part two protuberances (15*a*-15*b*) having very different shapes and dimensions, shaped and spaced apart in substantially parallel planes, with a connecting area (15*c*). The first, leading protuberance (15*a*) is larger, while the second, trailing protuberance (15*b*) is shorter in a specified ratio of height of the order of 1 to 5. The lever (15) also comprises an appendage (15*f*) whose height is such that it extends beyond the plane of the blade holder. This appendage (15*f*) has at its upper end a locking member (15*e*) oriented perpendicularly to the plane of the lever and facing the cutout formed in the bar (14). Thus the locking member (15*e*) can enter or withdraw from the cutout according to the stages of operation of the dispensing equipment, thus providing a locking function.

A description will now be given of the mode of operation of the device in its different stages, with reference to FIGS. 8-15 of the drawings.

FIG. 8: The dispensing equipment is not in operation and the cutting blade (6*a*) is withdrawn. In this case, the lever (15) associated with the blade holder is not stressed and is not in contact with the ring (10) through the ring's two protuberances (10*b*-10*c*). The inner flat (12*b*) formed on the non-circular ring (12) is located in a plane below the bar (14) associated with the drum. The withdrawn cutting blade (6*a*) is located on the front of the equipment. All of the protuberances of ring (10) and lever (15) are located towards the rear of the equipment.

FIG. 9: the drum is urged to rotate, according to the arrow (F), by the effect of the user's pulling a strip of material (B). The drum (4) therefore turns with respect to the supporting flanges (3), and the leading protuberance (15*a*) of the lever associated with the blade holder is only in contact with the curved face (10*e*) adjacent to the protuberance (10*b*). The bar (14) associated with the drum is substantially and diametrically opposed to the flat part (12*b*) of the flange (3). The second protuberance (10*c*) does not contact the lever at all.

Figure 10:
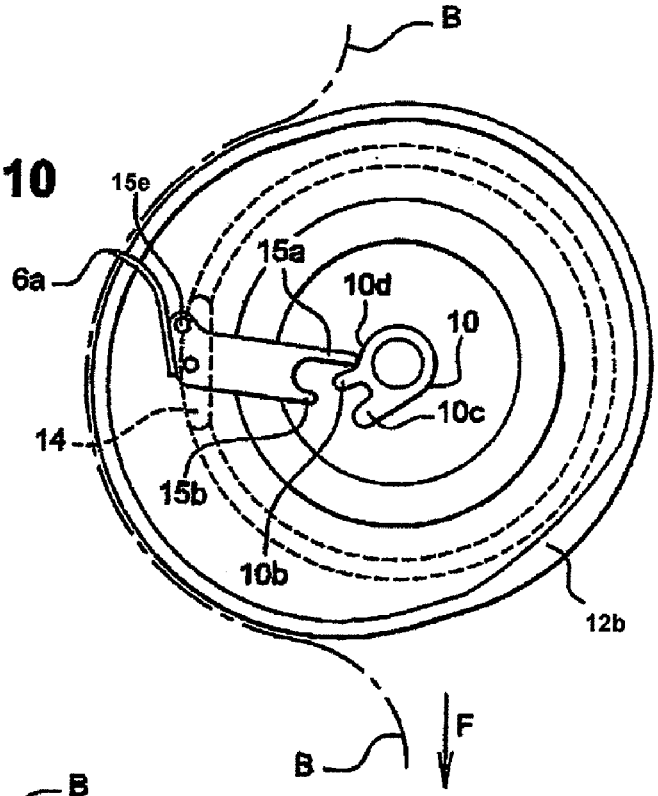

FIG. 10: the rotation of the drum continues to allow the cutting blade to be deployed. The pulled strip of material (B) is stretched and the pointed parts of the blade (6*a*) penetrate into the material. The protuberance (15*a*) of the lever continues to bear on the protuberance (10*b*) of the ring (10), while the protuberance (15*b*) still makes no contact. Also in this position, the locking member (15*e*) begins to move out of the cutout (14*c*) on the bar (14).

Figure 11:
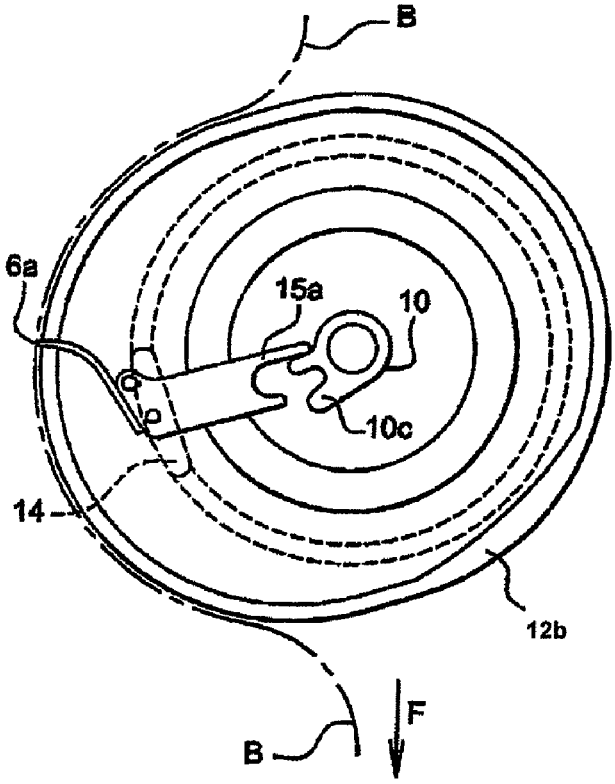

FIG. 11: the rotation of the drum continues as a result of the pulling by the user. The strip of material (B) is still partially pierced. This causes the first protuberance (15*a*) of the lever (15) to slide backward on the protuberance (10*b*) of the ring (10). The second protuberance (15*b*) of the lever approaches the second protuberance (10*c*) of the ring (10).

Figure 12:
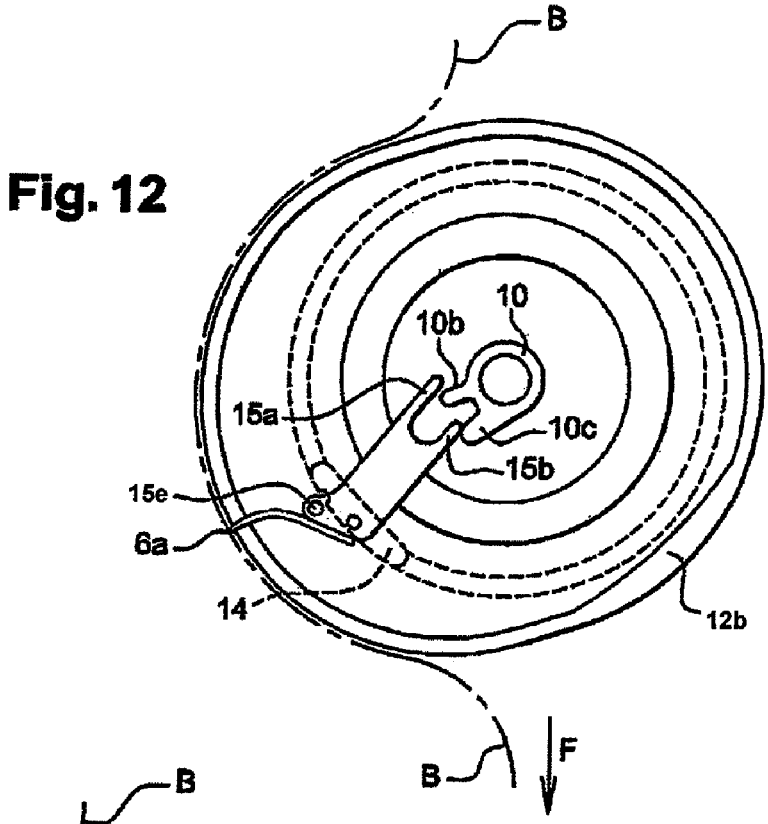

FIG. 12: the rotation of the drum continues with the cutting blade (6*a*) moved outwards by approximately ¾ of its travel; the material (B) is still not completely cut. The first protuberance (15*a*) of the lever has escaped from the first protuberance (10*b*) of the ring (10), while an initial contact has been created between the second protuberance (15*b*) of the lever and the second protuberance (10*c*) of the ring (10).

Figure 13:
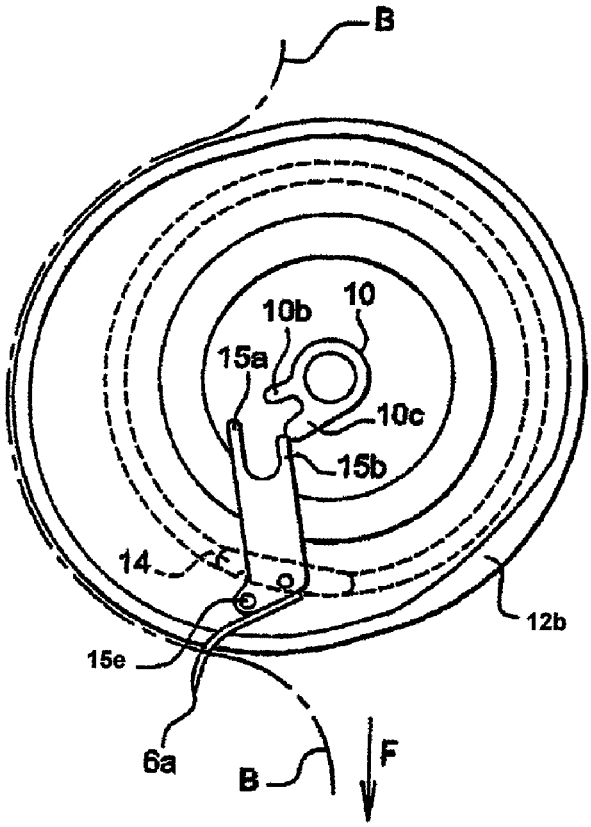

FIG. 13: the rotation of the drum continues, and the material (B) has been completely cut. The lever (15) has swung completely with a final contact between the second protuberance (15*b*) and the protuberance (10*c*).

Figure 14:
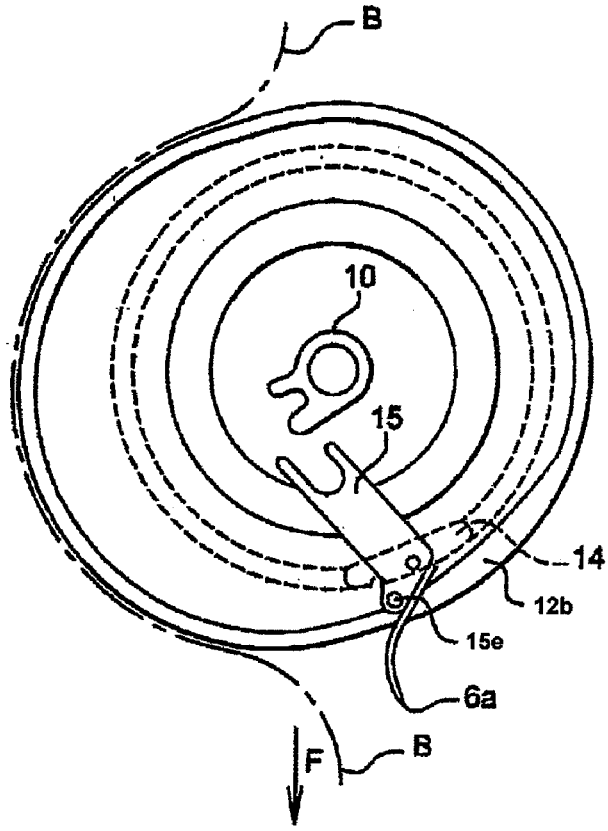

FIG. 14: the drum continues to rotate in this stage, corresponding to the return of the blade (6*a*). The lever (15) has escaped completely from the ring (10), and there is no longer any contact between the protuberances (15*a*-15*b*-10*b*-10*c*). The flat part (12*b*) formed on the ring (12) is in contact with the locking member (15*e*) and causes the locking member to return progressively into the cutout (14*c*) of bar (14), with the return swing of the blade (6*a*).

Figure 4:
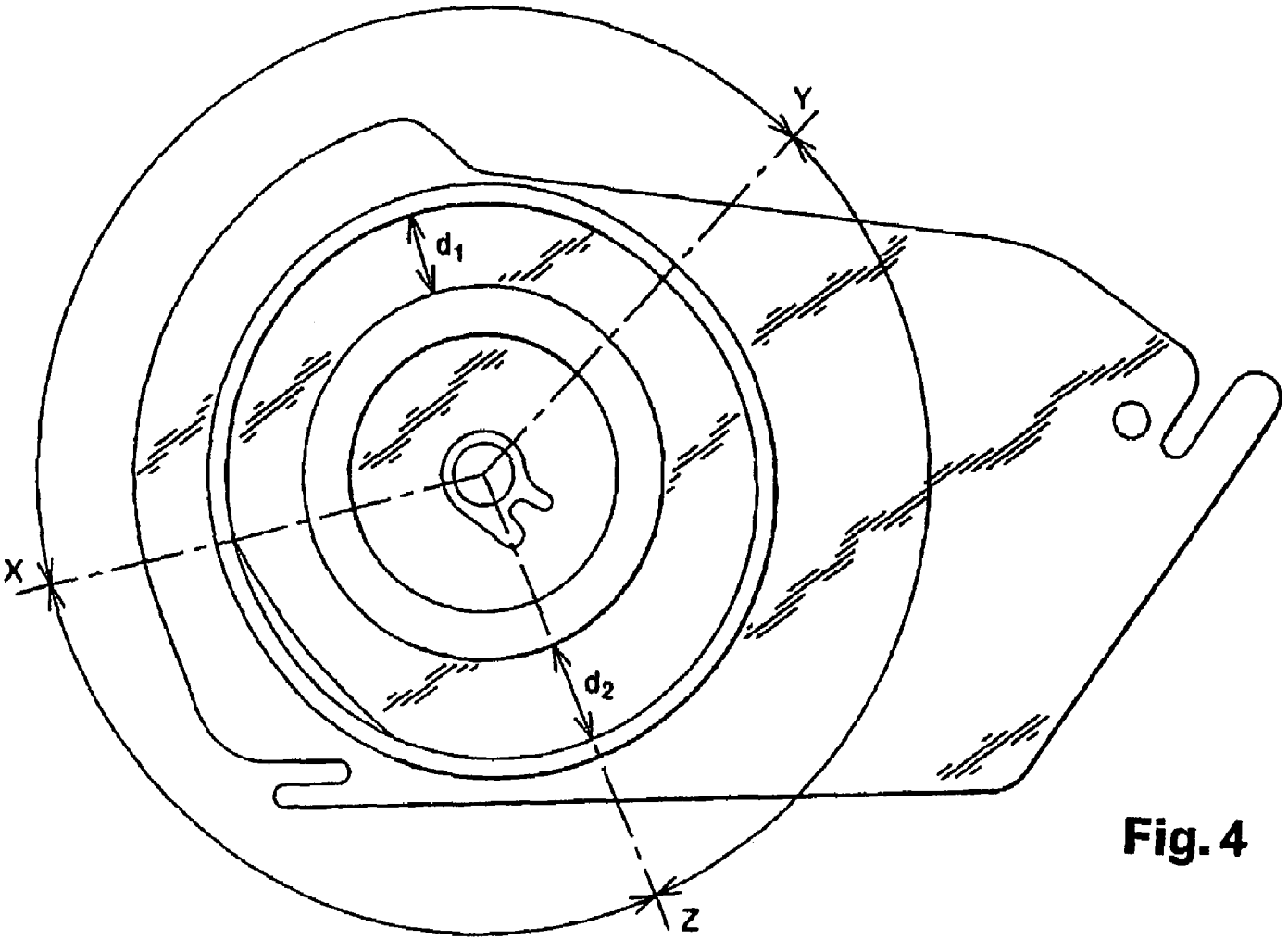
FIG. 4 is a plan view of the casing flange for receiving the fixed rings formed during molding.
Figure 15:
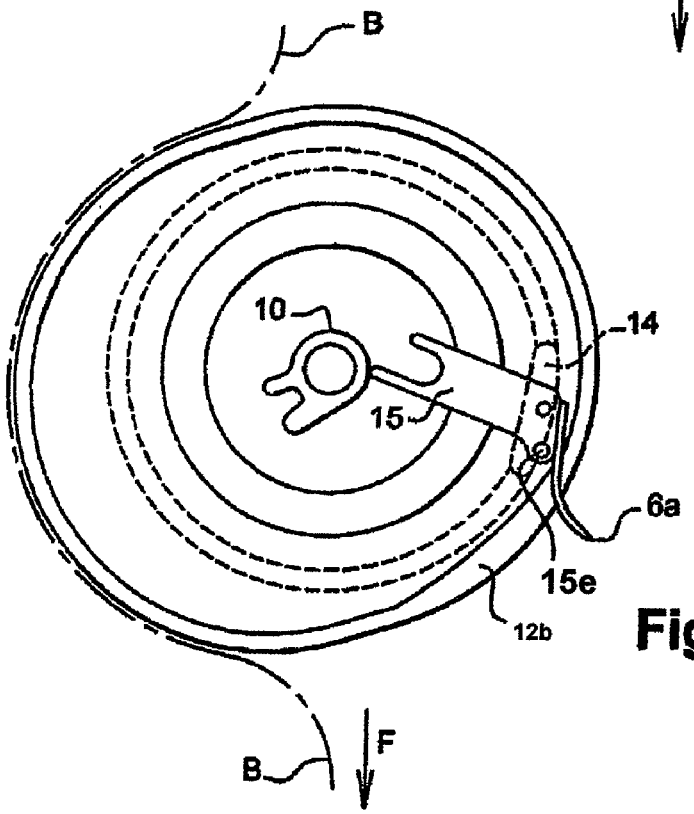

FIG. 15: the withdrawal of the cutting blade (6*a*) is complete, the locking member (15*e*) is again located in the cutout made in the bar (14), and the flat (12*b*) has returned to the initial position of FIG. 4.

The design described above yields numerous advantages. It is perfectly suited for cutting wiping material in smaller formats of the order of 11 inches or less. The equipment according to the invention operates noiselessly because of the elimination of the return spring of the blade holder of the drum. The guiding provided by the different profiles offers great flexibility and reliability in operation, without noise. The configuration of the non-circular ring (12) with its eccentricity is designed to permit satisfactory rotation of the drum during the movement of the blade holder lever associated with the locking member.

Figure 5:
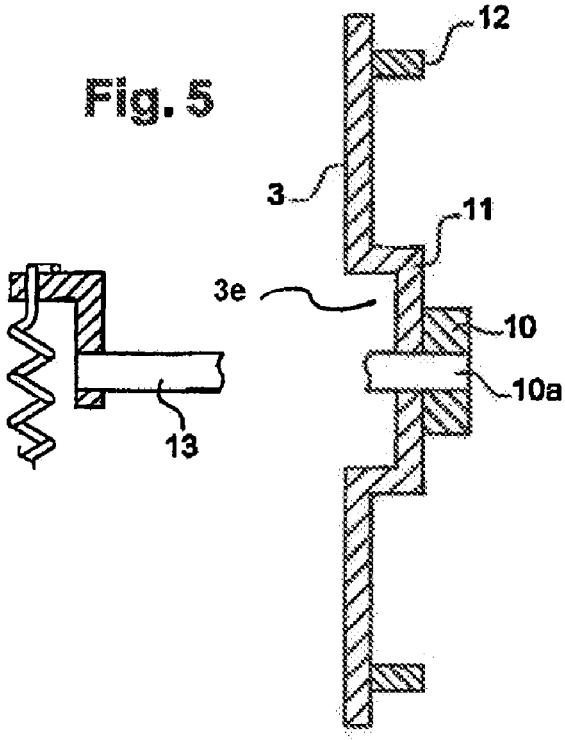
FIG. 5 is a partial sectional view of said flange.
Figure 6:
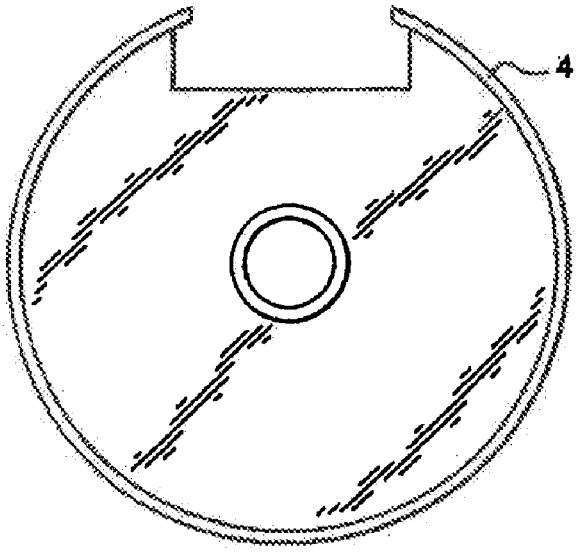
FIG. 6 is a view from the side of the drum.

With reference to FIG. 5, and without departure from the scope of the invention, the flange (3) of the casing provided with the rings (10-11-12) is formed on its outer side with a central void (3*e*) to minimize the overall dimensions so that it can be incorporated in the casing of the equipment while permitting the passage of a known return means associated with the locking axis (13) of the drum.

The advantages are made clear by the invention. We would emphasize the simplicity of the device and the possibility of manufacturing the various components as molded parts, thus reducing the assembly work.

The present invention was devised to tackle a problem which arose for formats of cut material which might be of the order of 11 inches, but, without departure from the scope of the invention, this invention can be applied for larger formats.

The invention claimed is:

1. A dispensing apparatus comprising a casing with cover, said casing including arms supporting a reel of wiping material in an upper part, and including, in a lower part, a drum rotatably mounted between first and second flanges, said drum having a cutting blade fixed to a cutting blade holder which pivots relative to the drum during a cutting sequence, said reel bearing on said drum or being suspended above said first flange, said first flange having a first central ring, formed on an inner side of said first flange allowing for passage of a locking axis of said drum, said first ring having an external profile comprising a first fixed set of protuberances, a lever associated and pivoting with the cutting blade holder, and comprising a second set of protuberances, said external profile constitutes a guide path for said lever, interaction between said first and second sets of protuberances permits said outward pivotal movement of said cutting blade to perform said cutting sequence during rotation of said drum resulting from pulling of said wiping material by a user, wherein said first flange is provided with a second projecting ring and a third ring both fixedly formed on said inner side of said first flange facing said drum and being applied against a facing edge of said drum, wherein a lateral edge of an end flange of said drum has a projecting bar for pivotably receiving the cutting blade holder, said bar having a cutout for receiving a locking member formed on said lever, wherein said third ring interacts with said locking member at one stage of operating during the rotation of said drum, said third ring has a non-circular profile with an eccentric offset part, and said third ring has a rectilinear flat extending at an angle of the order of approximately 25° to 35° for pushing said locking member.

2. The apparatus as claimed in claim 1, wherein the first fixed set of protuberances comprises two substantially adjacent shaped protuberances, between which a space is provided, the two protuberances forming teeth, and wherein height of a first of said two substantially adjacent shaped protuberances is substantially greater than height of a second of said two substantially adjacent shaped protuberances relative to said drum, and wherein said space is provided to permit passage of one of the protuberances of said second set.

3. The apparatus as claimed in claim 1, wherein said second ring is concentric with an axis of the first ring and the locking axis of the drum, and wherein said second ring has a circular shape and an outer periphery facing a substantially curved inner profile of said bar.

4. The apparatus as claimed in claim 1, wherein said bar pivotally receives an end of a shaft of said blade holder in an aperture, wherein said bar has a lower profile which is substantially curved without being in contact with an outer peripheral edge of said second protruding ring, and said cutout is located on an upper profile of said bar opposite said lower profile.

5. The apparatus as claimed in claim 1, wherein the lever is positioned adjacent to a space in the drum and between an end portion of the cutting blade and an inner surface of the bar, and wherein when said rectilinear flat pushes said locking member, said cutting blade pivots inward relative to said drum.

6. The apparatus as claimed in claim 5, wherein a first, leading protuberance of the first set is elongated, while a second, trailing, protuberance is shorter in a specified ratio of height of the order of 1 to 5, and wherein the lever has an appendage whose height is such that it projects beyond a plane of the blade holder, said appendage having at its upper end the locking member oriented perpendicularly to a plane of the lever and facing the cutout in the bar.

7. The apparatus as claimed in claim 1, wherein the non-circular profile of the third ring has three sectional areas XY, YZ, ZX, permitting passage of the lever in different stages of operation and having different configurations, a first area XY being circular, a second area YZ having a radial amplitude variation and eccentricity, and a third area ZX providing a radial amplitude decrease and connection to said rectilinear flat, and wherein a peak point Z, representing a largest distance between portions of the second and third rings, is located along an extension of a second of the protuberances of the first set.

8. The apparatus as claimed in claim 7, wherein the first area XY covers an angular sector of the order of 148°, the second area YZ covers a sector of the order of 118° and the third area ZX covers a sector of the order of 94°.

9. The apparatus as claimed in claim 1, wherein the first flange is provided with a central void on its exterior.

* * * * *